United States Patent [19]

Ban

[11] 4,263,857

[45] Apr. 28, 1981

[54] TRAVELING GRATE STOKER FOR THE COMBUSTION OF DIFFICULTLY IGNITED FUELS

[75] Inventor: Thomas E. Ban, South Euclid, Ohio

[73] Assignee: Dravo Corporation, Pittsburgh, Pa.

[21] Appl. No.: 1,018

[22] Filed: Jan. 5, 1979

[51] Int. Cl.[3] ..... F23H 11/10

[52] U.S. Cl. ..... 110/270; 110/348

[58] Field of Search ..... 110/270, 315, 348, 297

[56] References Cited

U.S. PATENT DOCUMENTS

| | | | |
|---|---|---|---|
| 1,324,884 | 12/1919 | Duncan | 110/270 |
| 1,614,237 | 1/1927 | Grunert et al. | 110/270 |
| 4,109,590 | 8/1978 | Mansfield | 110/270 X |

*Primary Examiner*—Edward G. Favors

*Attorney, Agent, or Firm*—Parmelee, Miller, Welsh & Kratz

[57] ABSTRACT

A cross fire stoker adapted to burn a difficultly ignited fuel is disclosed, together with a method of operating the stoker. The stoker is adapted to burn such fuel in a furnace not having large front or rear arches and includes a horizontal traveling grate within the furnace which is adapted to convey a bed of solid carbonaceous fuel from a charging zone, through an ignition zone, through a firing zone, and to an ash discharging zone. A suction fan is provided at the initial windbox to downdraft an oxygen-containing fuel to the bed at an ignition zone closely adjacent said charging zone. The remainder of the bed is subjected to updrafting for firing the bed to reduce it to ash.

7 Claims, 1 Drawing Figure

TRAVELING GRATE STOKER FOR THE COMBUSTION OF DIFFICULTLY IGNITED FUELS

BACKGROUND OF THE INVENTION

Traveling grate stokers supply solid fuels to furnaces so that the thermal energy of the fuel may be absorbed by boiler tubes or other heat recovery apparatus. Such stokers operate by continuously charging a layer of coarse-sized coal on a traveling grate which may be either a chain grate or a bar grate, igniting the surface of the coal by radiation of heat from incandescent coal flame and refractory arches, perpetuating the combustion by forcing updraft through the surface-ignited layers of coal while it is being transported horizontally beneath boiler tubes or other heat recovery apparatus, terminating the combustion by continuous updraft and cooling of the residual ash, and discharging the ash of spent coal from the discharge end of the stoker.

A chain grate stoker consists of a series of chain links strung on rods in a staggered arrangement and moved by sprockets or drums, while a bar grate surface consists of rows of keys strung on bars which are in turn carried by chains driven by sprockets.

Bituminous coals are readily ignited because they immediately evolve gaseous vapors of condensable, volatile matter and gases of volatile matters which ignite at approximately 400° F. and provide a highly luminous flame which transmits heat to refractories for reflection to the coal bed, as well as direct reflection of the luminous flame to the coal surface particles.

Difficultly ignited fuels generally contain lower quantities of combustible, volatile matter and hence do not evolve appreciable amounts of luminous flames for back radiation effect. Fuels, such as anthracite, coke breeze, chars, and a pelletized fuel such as the pellet fuel set forth in U.S. applications Ser. Nos. 763,226 and 898,798, field Jan. 27, 1977, and Apr. 24, 1978, respectively, are in the category of difficultly ignited fuels. Ordinarily, large, gently sloping, front arches and large rear arches constructed above the combustion bed of a traveling grate stoker are used to burn a difficultly ignited fuel. Most of the furnaces are provided with a rear arch and a relatively small front arch, but front arch and combination front and rear arch furnaces enjoy widespread use. Such refractory arches provide an abundance of radiation surfaces for reflecting heat and igniting the fuel and directing the draft toward the oncoming fuel for reignition. Examples of such stokers may be found in *Comubstion Engineering*, Glen R. Fryling, editor, Rev. Edition 2nd Impression; published by Combustion Engineering, Inc. 1967, chapter 18.

SUMMARY OF THE INVENTION

It has been found that difficultly ignited fuels, such as the fuel set forth in the above-noted applications can be ignited without the necessity of large front and/or rear arches. This may be accomplished by a simple improvisation of utilizing a downdraft ignition windbox zone prior to the terminal updraft combustion and cooling windbox zones of the chain grate stoker.

A number of tests were conducted by firing a pellet fuel which was produced as set forth in the above-mentioned applications, and those tests were performed in a stoker designed for bituminous coals. Since bituminous coals are volatile, and do not require substantial amounts of reflected heat for ignition, the stoker has a relatively small front arch. After many trials, the system failed to continuously ignite the pellet fuel. However, by applying an initial downdraft section adjacent to the initial updraft windbox, a partial of the total fire was induced to the pellets and ignited the surfaces within the downdraft zone. As the pellets progress to subsequent combustion zones, ignition and combustion are sustained, allowing fuel continuity for combustion.

BRIEF DESCRIPTION OF THE DRAWING

The drawing schematically illustrates a cross feed stoker according to this invention.

DETAILED DESCRIPTION OF THE INVENTION

Figure 1:
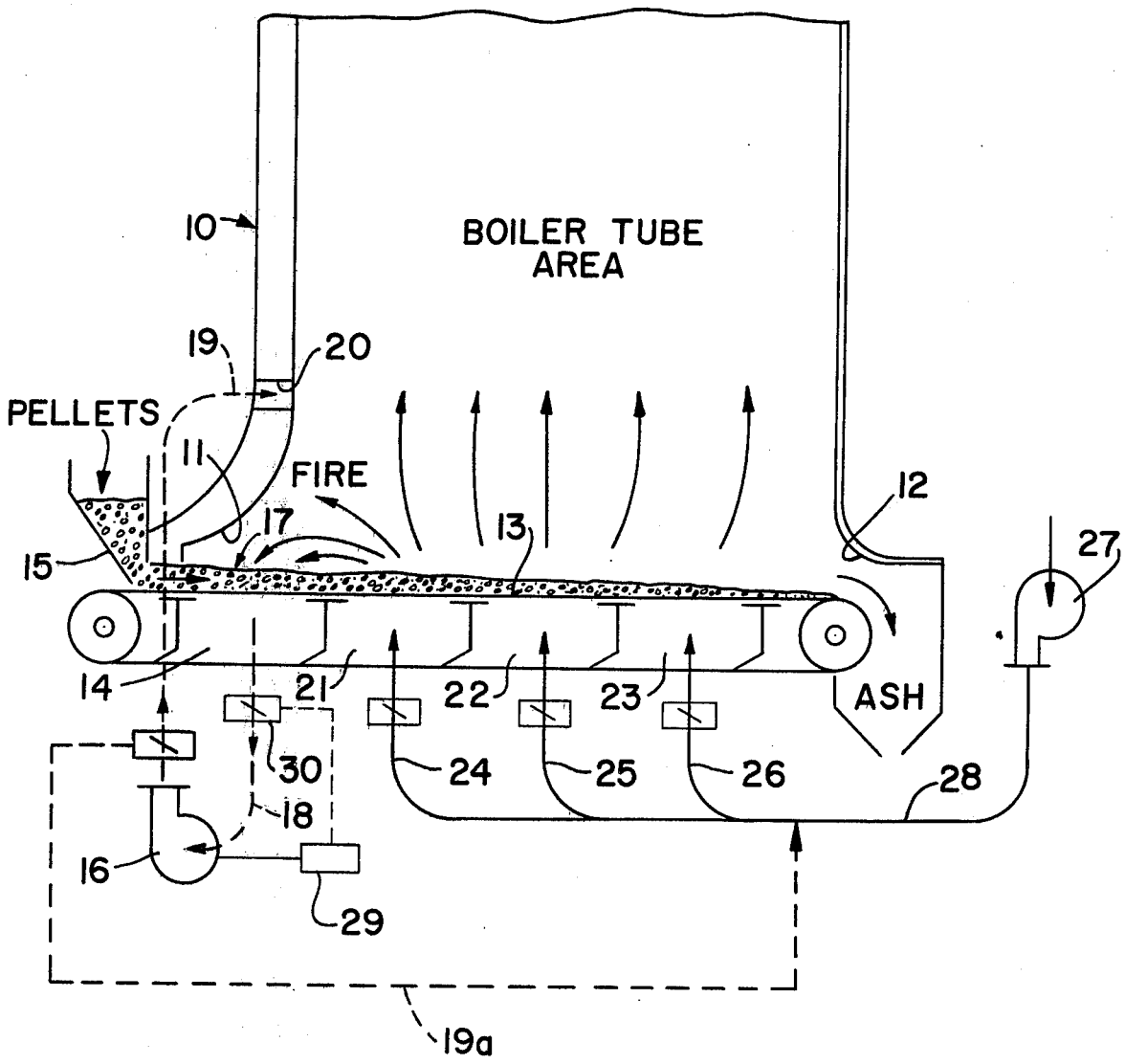

There is illustrated in the drawing a furnace 10 having a relatively small front arch 11 and a relatively small rear arch 12. The furnace 10 is ideally suited for burning bituminous coal, since coal is readily volatilized and ignited as it is conveyed into the furnace by a traveling grate 13. Such a furnace has many desirable features in that the lack of deep arches presents more of the coal bed to the boiler tube area for greater fuel efficiency rather than employing deep arches which capture radiant heat for ignition but which also tend to block the tube area. Moreover, deep arch furnaces may occupy excessive space within a plant. It has been generally recognized that difficult-to-ignite fuels cannot be employed in a furnace having relatively shallow arches because of ignition problems therein.

However, according to the present invention, there is provided an initial windbox 14 beneath the upper reach of the traveling grate 13 and closely adjacent a loading zone or hopper 15. A suction fan 16 provides a downdraft in an initial ignition zone 17 to draw partials of the total fire into the pellets and then draw combustion gases downwardly from the windbox through a duct 18. Those gases are then cycled back to the furnace through a duct 19 and through a port 20 to serve as overfire air. Also, a partial of these gases can be directed to windboxes for updraft combustion reaction through duct 19A.

The remainder of the bed is updrafted with air through windboxes 21, 22, and 23 by way of branch ducts 24, 25, and 26, which are connected to a blower fan 27 by a main duct 28. As the pellets progress from the ignition zone 17 to subsequent combustion zones, ignition and combustion are sustained, allowing fuel continuity for combustion. The following table provides an example of conditions of operations which were maintained for firing pellet fuel produced in accordance with the aforementioned applications.

TABLE A

CONDITION OF OPERATIONS OF CHAIN GRATE STOKER USING CLEAN PELLET FUEL

| | | | |
|---|---|---|---|
| Grate size | 8 ft. × 12 ft. | | |
| Feed | $-\frac{3}{4}$ in. + $\frac{1}{4}$ in. clean pellet coke | | |
| Feed composition: | Moisture | 5-22% | |
| | FC | 37.36% | |
| | VM | 22.06% | |
| | Ash | 40.58% | |
| | S | 2.85% | |
| Feed rate | | 1440 | lbs./hr. |
| Feed depth | | 5 | in. |
| Grate speed | | 2.2 | in./min. |
| Windbox conditions: | No. 1 | −.1 | in. $H_2O$ |
| | No. 2 | +.2 | in. $H_2O$ |
| | No. 3 | +.1 | in. $H_2O$ |

TABLE A-continued

| CONDITION OF OPERATIONS OF CHAIN GRATE STOKER USING CLEAN PELLET FUEL | |
|---|---|
| No. 4 | +.05 in. $H_2O$ |

During the tests, with the provision of a preliminary downdraft, it was learned that approximately one-tenth to one-twentieth inch of vacuum should be maintained in the initial windbox to provide induced draft as conductive heat transfer for ignition of the charge approximately one-half inch deep of incandescence within the surface of the bed. The remaining lower layers of charge of approximately four to eight inches thick remain unignited and served to store sensible heat from the downdraft.

In view of surface ignition only, a small amount of heat is withdrawn from the initial windbox and this is less than 200° F. in temperature. Draft withdrawn in this manner is readily directed as secondary air of combustion to provide overfire for combustibles within the flame and uncombusted gases. Also, a partial can be directed to windboxes for updraft combustion reactions.

The downdraft fan 16 may be equipped with a temperature sensing device such as the thermocouple 29 which controls a damper 30 to ensure that the downdraft does not exceed 250° F., which would be indicative of excessive downdraft ignition intensity, loss of heat, and thermal damage to the traveling grate. Such control is automatically accomplished by the damper 30, which throttles the induced draft to a partially closed position when temperatures approach 250° F.

A relatively high volume of draft is directed immediately after the initial downdraft ignition in the windbox 21 to provide flame and immediate hot gases for downdraft induced toward the downdraft zone. The remaining windboxes 22 and 23 can carry moderate draft flow to terminate combustion as is normally acquired with normal fuels.

The present invention, therefore, permits the conversion of a commercial stoker from a normal bituminous coal firing system to the above-described system for firing difficultly igniting fuels. Such conversion may be made in a matter of days rather than in months which would be required to design and hang rear arches for modifying the commercial stoker to use difficultly ignited fuels.

What is claimed is:

1. A method of operating a crossfeed stoker for a steam generator, comprising the steps of moving a single layer of a solid carbonaceous fuel bed within a furnace along a substantially horizontal path by a traveling grate from a fuel charging zone to an ash discharging zone, igniting the top surface of said bed adjacent said charging zone, forcing an oxygen-containing fluid downwardly through the bed at an ignition zone closely adjacent the said charging zone to stabilize ignition, and forcing an oxygen-containing fluid upwardly through said bed between said ignition zone and said ash discharging zone so that the ignition progresses downwardly through the bed.

2. A method of operating a crossfeed stoker according to claim 1, wherein said fluid is air.

3. A method of operating a crossfeed stoker according to claim 2, wherein said air is withdrawn from said furnace and is then reintroduced into said furnace as overfire air.

4. A method of operating a crossfeed stoker according to claim 2, wherein said air is withdrawn from said furnace and then re-introduced into said furnace as overfire air and updraft media.

5. A method of operating a crossfeed stoker according to claim 1, wherein said fluid is forced upwardly through said bed at higher rates adjacent said ignition zone than adjacent said discharge zone.

6. In a crossfeed stoker for a steam generator comprising a horizontal traveling grate within a furnace, means defining a charging zone for introducing solid carbonaceous fuel in a bed on said traveling grate, a plurality of windboxes beneath said traveling grate, an exhaust fan in fluid communication with the windbox immediately adjacent the charging zone to draw air downwardly through the bed in an ignition zone, and means to apply a vertical updraft through the remainder of the bed by way of the remaining windboxes, the improvement comprising: thermocouple means to sense the temperature of the fluid drawn through said exhaust fan and means responsive to said thermocouple means to reduce the fluid flow through said exhaust fan if the temperature of the fluid exceeds a predetermined value.

7. In a crossfeed stoker according to claim 6, the improvement wherein said means responsive to said thermocouple comprises a damper in a duct between said exhaust fan and the windbox immediately adjacent the charging zone.

* * * * *